US005567496A

United States Patent [19]

Svehaug

[11] Patent Number: 5,567,496

[45] Date of Patent: Oct. 22, 1996

[54] MARTIAL ARTS BOARD

[76] Inventor: Oswald C. Svehaug, 125 N. Glover, Chula Vista, Calif. 91910

[21] Appl. No.: 384,317

[22] Filed: Jan. 31, 1995

[51] Int. Cl.[6] ..... B32B 3/06

[52] U.S. Cl. ..... 428/60; 428/58; 428/192; 482/83

[58] Field of Search ..... 428/58, 60, 99, 428/192; 482/83; 434/247

[56] References Cited

U.S. PATENT DOCUMENTS

| | | | |
|---|---|---|---|
| 4,776,584 | 10/1988 | Tilley et al. | 482/83 |
| 5,131,896 | 7/1992 | Hutchings | 482/83 |
| 5,196,249 | 3/1993 | Svehaug | 428/58 |

*Primary Examiner*—Alexander Thomas

*Attorney, Agent, or Firm*—Ralph S. Branscomb

[57] ABSTRACT

A breakaway board for practicing chops and kicks in karate and other martial arts improves upon the prior an by increasing control over the board by the board holder. The paired mortise- and-tenon interlock between the two breakaway halves is modified by including a detent in one or more of the pairs between mortise and tenon such that the two halves definitively snap into place when they are reassembled so that the person holding the board can be assured that the two halves are fully together. Additional protection for the board holder is provided by an improved palm pad to prevent bruising after repeated strikes, and to accommodate board holding handles, the front faces of the two halves are grooved at the top and bottom edges to provide a positive seat for the resilient cord characteristic of these board holders.

11 Claims, 3 Drawing Sheets

MARTIAL ARTS BOARD

BACKGROUND OF THE INVENTION

Martial arts has experienced a rebirth of interest in the last few years, as it has been known to do periodically. The children watching the "Power Rangers" TV show and the "Ninja" movies muster out in numbers at Karate schools, wherein they hone their skills and mental discipline and gamer the physical strength necessary for their art. During this process of converting millions of these gems-in-the-ruff to seasoned combatants, many wooden karate-chop boards must be broken with hands and feet in order for the students to judge their own progress, and for exhibitions to recruit more to the field of contact self-defense.

Whereas the practice of using wooden boards in such way, that is breaking them and throwing them away, falls short of burning rain forests in its impact on the world ecology, nonetheless there is no point in wasting wood, and it can become an unneeded expense to the school, and no doubt makes some impact on the ecology. For this reason synthetic boards have been developed, having breakaway halves which can be reassembled for re-use. The instant inventor has developed one of these boards, which is illustrated in U.S. Pat. No. 5,196,249 issued Mar. 23, 1993, and its continuation-in-part, U.S. Pat. No. 5,204,151 issued Apr. 20, 1993. These patents disclose a board which is created from a very tough plastic in a relatively complex injection mold. It is made in such a way that the two halves of the board are identical, coming from same mold cavity, each having staggered mortises and pegs which interfit with those of the other half to define a smooth, continuous integral breaking board when fully integrated.

The juncture between the mortises and the tenons is such that a certain compressibility is incorporated into the tenons, and corresponding expandability in the mortises so that in addition to being longitudinally slid together in the plane of the board when assembled, the board can also be separated into its two halves in a hinging action with no longitudinal separation at all, when impacted by a blow from the from while the side edges are being held by an instructor.

This board works quite well, and is even adjustable to accommodate the lesser breaking strengths required for junior athletes. In fact, any drawbacks it may have are not drawbacks to the training combatant, but to the person holding the board while it is being kicked. It is an unnerving experience for the novice, holding the board inches from his face while a foot moving a hundred miles an hour makes contact with the wood. Not surprisingly, the board holder often worries that the board will fly off and wind up in his face. Or the impact of the board on his hands will hurt, or that the board halves are not adequately attached together so that it will offer insufficient resistance and all of the forward momentum of the kick will be transferred into the board halves flying toward his face at almost-literally breakneck speed.

Whereas this fear may be unfounded, it is real insofar as its impact on the length of the line of eager board-holder volunteers is concerned. This alone offers good reason to improve the construction of the board and provide the holder with more control.

As an example, whereas the board works quite well when the two halves are pushed together, there is no definitive way of knowing to a certainty that the boards are mated all the way. Visual surveying may suggest that they are, but if someone who is holding the board took it in the chops during the last session because the board had not been fully joined, more than a visual surmise may be necessary to still his nerves this time around. What the person holding the board would really like is a definitive, tactile and audio "snap" characteristic of some connectors when the board halves reach full integration, so that complete connection would no longer be a matter of speculation.

To protect the holder, board holder handles have been developed comprising two hand grips, the hand grips each defining a flat stage to which the outer portion of the respective board half is affixed with a resilient cord. The karate kicker breaks the board and the board pivots around the handgrip toward the holder harmlessly, the two sides being held back by the handgrips. These devices reduce the wear on the hands and the wrists, and give the board holder the illusion that there is something that really will protect him, between himself and the flying foot. On being experientially disabused of this notion, the next time around he may feel inclined to take his chances with the bare board itself on the theory that at least he can wrap his fingers around it and be more in control of whether it flies into his face or not. But the fact is, holding the board without any kind of holder soon becomes very hard on the hands, as impact after impact is delivered straight through the board to the palms and wrist bones.

The person holding the board would be grateful for some accommodation to his soft tissue, and at the same time could appreciate a feature that would enable the board to be definitively captured by board handles in a manner that there would be no substantial chance of a board half flying off in his face.

SUMMARY OF THE INVENTION

The instant invention addresses the above-stated concerns, being a breaking board that is more comfortable that currently used synthetic boards, and is appreciated by those behind the kickboards as a true blessing.

To alert the e operator when the board is fully joined together, one of the tenons on each of the boards, and its mating mortise on the other board, are provided with detent dimples which snap into congruence as the tenon is pushed into the mortise to its furthest extent. This "snapping" action is psychologically very comforting to one holding the board. After use, the two halves are pressed together again, generating the definitive snapping action that signals the assistant that there has been an unequivocal joining of the two halves, reducing the agenda of items he has to worry about by one-third, leaving only flyaway board halves which fly off the handle, and repetitive traumatic hand injury.

Addressing the these remaining concerns, in order to improve the board engagement by standard handles that use the resilient "bungee cord" restraints, groves are defined in the upper and lower edges of the two halves to seat the cord, with the depth of the grooves and the strength of the bungees being adequate to virtually assure that there will be no separation in use.

Lastly, a beefed-up palm pad is included in the outer rear portion of each of the board halves. Although palm protection has not been ignored in the past, special techniques are needed to accommodate the abuse that these pads will take on the firing line from the more aggressive of the martial arts aficionados. The pad is a soft polymer which is molded directly into the main plastic body of the board. The board body defines a series of hollow mold cylinders beneath the side edges, and when these cylinders are filled with plastic they define "dead men" to anchor a series of tendrils which extend up through the body of the board to the pads. These tendrils increase in number at the ends of the pads so that they cannot be worried off by the nervous fingers of fidgety students. This tough pad provides the necessary protection in addition to the other control features to maximize the chances that the someone holding the board this week will not disappear by next week's class.

DETAILED DESCRIPTION OF THE PREFERRED EMBODIMENT

The martial arts board 10 of the invention is very similar to the previously patented model which appears in U.S. Pat. No. 5,204,151, and U.S. Pat. No. 5, 196,246. The board of the above-referenced patents is a successful contribution to the martial arts community, but experience with it has led to the improvements described herein, which increase control over the board by the person holding it for the kicker or striker.

Figure 2:
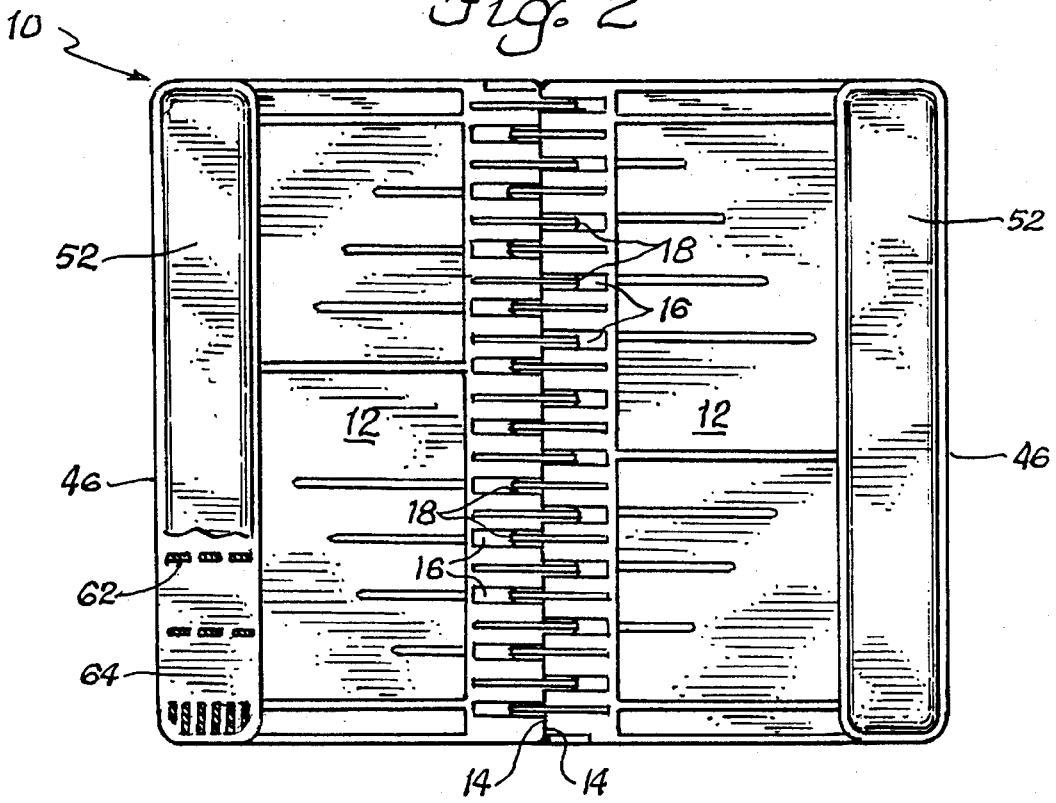
FIG. 2 is a bottom plan view of the martial arts board of FIG. 1, with a portion of the left palm pad cut away.
Figures 3, 4, 5, 6, 7, 8:
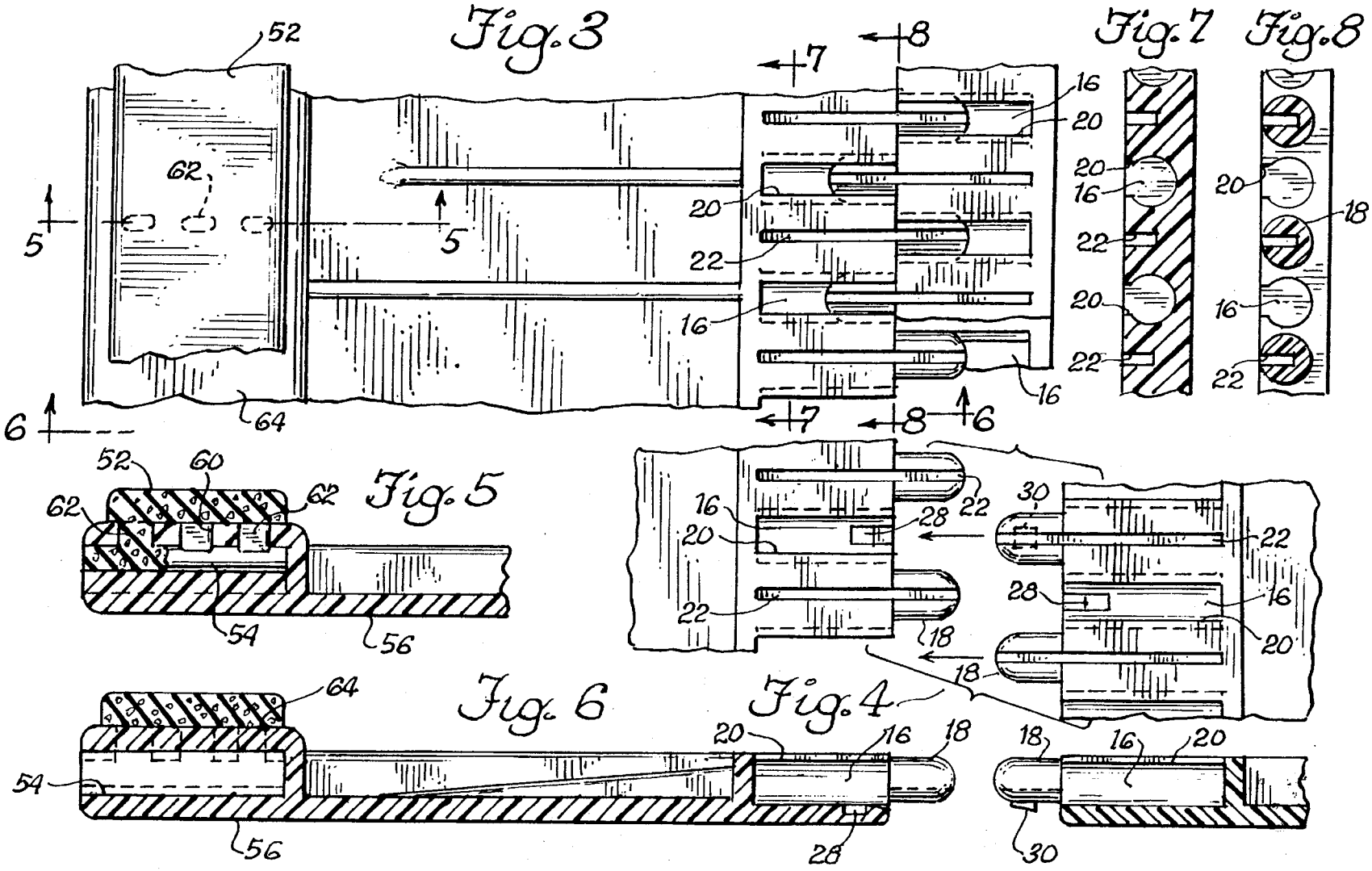
FIG. 3 is a fragmentary plan view of the underside of the martial arts board.
FIG. 4 is a is a fragmentary view similar to FIG. 3 but of a smaller fragment and illustrating separation of the mortises and tenons.
FIG. 5 is a is a section taken along line 5—5 of FIG. 3 illustrating the tendrils reaching into a molded cylindrical "dead man"
FIG. 6 is a section taken along line 6—6 of FIG. 3.
FIG. 7 is a is a section taken along line 7—7 of FIG. 3.
FIG. 8 is a section taken along line 8—8 of FIG. 3.

The full board 10 is separable into two identical board halves 12 shown in FIG. 2. Each half is identical to the other and is produced from the same mold cavity. The halves are made of tough ABS plastic that can withstand an indefinite number of poundings, and each defines a mating edge 14 having alternating mortises 16 and tenons 18 which engage in the respective complimentary structure of the other half to define mortise-tenon coupling pairs or sets. The manner in which this works is illustrated in FIG. 5, wherein it can be seen that the tenons project about half an inch from the flat part of the mating edge, and penetrate the mortises of the other board by the same amount.

Because the board is made out of tough plastic, in order for the tenons to engage the mortises with a resilient frictional fit, each mortise terminates at its lower edge in a relatively wide-open grove 20. Thus enables the mortise to expand, and a corresponding slot 22 defined in the tenon allows it to compress, so that a tight compression fit occurs on mating the two halves. By observing the interface between the two mating edges it can be determined that the two halves are fully mated when the interface space closes to zero. However, it not always apparent to one holding the board, who is observing it from behind, that the board in necessary fully mated. A litmus-test signal is created by incorporating a snap-action detent feature in the outer two of the mortise-tenon sets.

Figure 1:
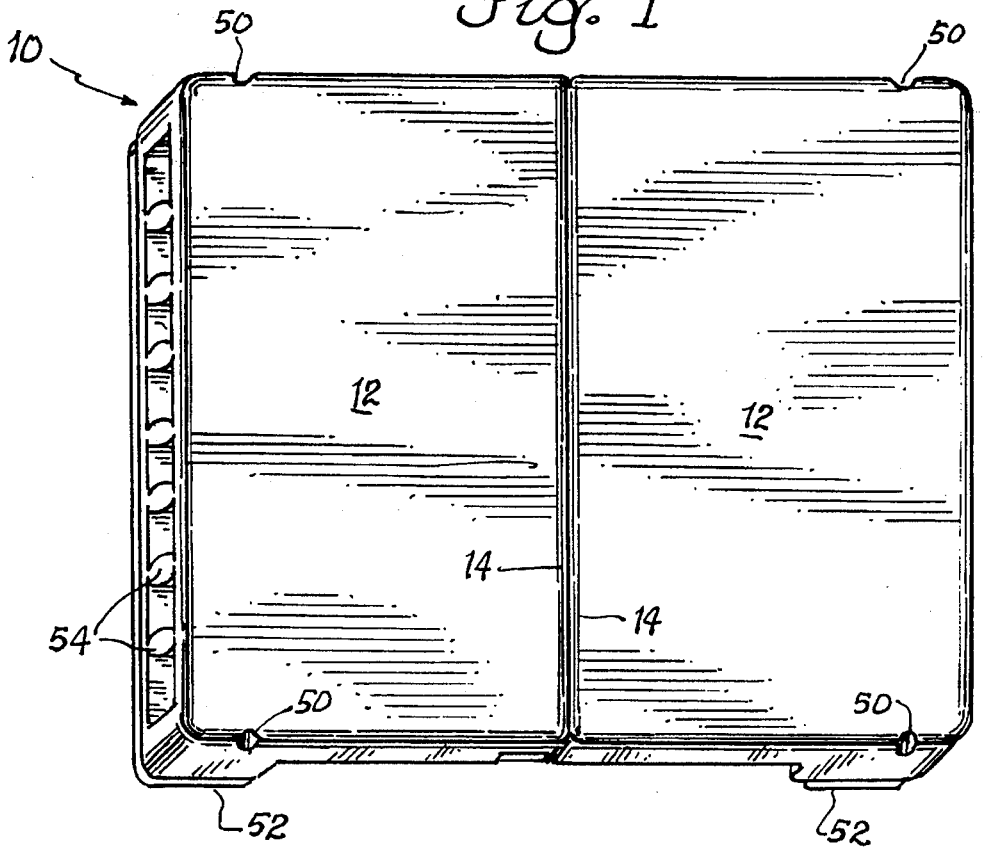
FIG. 1 is a top plan view, partially in perspective, of the martial arts board assembled and ready for use.
Figure 12:
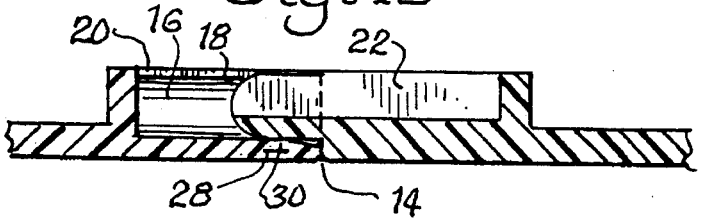
FIG. 12 is an enlarged sectional detail illustrating the engagement of the two dimples which form the detent; and, FIG. 13 is the enlarged detail of FIG. 12 shown after impact and separation of the two board halves.

When mated head-on in the configuration shown in FIGS. 1 and 2, each mortise receives one tenon, with this individual pair being referred to herein as a "coupling set". The interface is held together by more than twenty such coupling sets. Two of these coupling sets are different than the rest and will be referred to as "detent sets". These mortise and tenon sets incorporate the snap-action detent illustrated in FIG. 6, and enlarged in FIGS. 12 and 13. The detents themselves consist of a concave and convex dimple 28 and 30 respectively, defined in the interface between the mortise and tenon of each detent set. As illustrated in FIG. 12, when fully mated, the dimples snap into an overlying mated congruence. When in this configuration, it would be very difficult to pull the board halves apart longitudinally as can be understood from an examination of FIG. 12. The convex dimple has an abrupt edge which engages a corresponding edge of the concave dimple to prevent expanding sliding movement of the two board halves.

Figure 13:
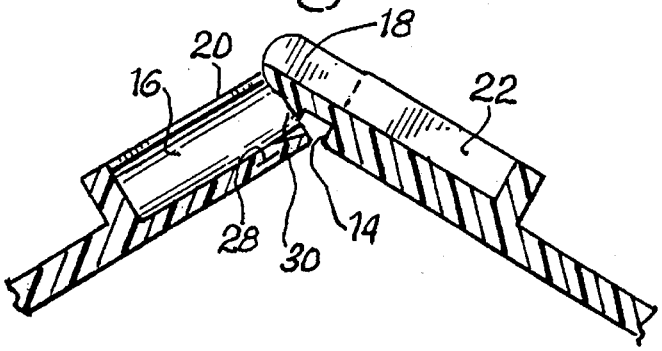

However, as shown in FIG. 13, when the board is kicked or struck with the hand, the two halves undergo a hinging motion rather than a sliding motion, as illustrated in FIG. 13, with the result that there is effectively no resistance to the hinge-action separation of the two halves produced by the mated dimples. The convex dimple swings out of the overlying position it was nested in the concave dimple without having the opportunity to offer resistance.

Thus, the detent structure affects only longitudinal motion, the closing of the board and any attempt to open it by reversing the closing, joining motion. But the force with which it resists a kick or hand blow is not affected. When the two halves slide together, a very definitive "snap" can be both felt and heard by the person assembling the two halves. Not only is this encouraging to the person who will hold the board for the kicker, but it also does in fact prevent the board from inadvertent separation by longitudinal extension of the two halves.

One of the features of board as described in the previous patents issued to the inventor is its ability to be adjusted in its threshold breaking resistance by staggering the interface edges of the two halves so that less than the full mating edge joins with the other board half. By putting the detent structure in the outermost two coupling sets, if the halves are offset in the proper direction, the two tenons with the detects will still be effective no matter how narrow or wide the board is made. In the opposite direction of offset, the tenons would move out of engagement with the mortises and the detects would have no effect.

To enable the offset to be effectuated according to the first arrangement wherein the detent tenons and mortises are fully engaged no matter the adjustment, the concave dimple is molded not only into the coupling set but also the adjoining mortise-tenon sets up to half way across the board, so that as the offset increases, the convex dimple will hop from one concave dimple to the next and there will always be a mating, nesting pair of dimples in the two outermost coupling sets along the board interface. Of course, every coupling set could be provided with a concave and convex dimple, but this is not necessary as two detects are quite adequate for the purpose.

As shown in FIGS. 12 and 13, the convex dimple in defined in the preferred embodiment on the tenons 18, but they could be equally easily defined in the surface of the mortises, and for this reason the claim language is left purposely ambiguous regarding which of the two elements defines the concave or the convex dimple.

Figure 9:
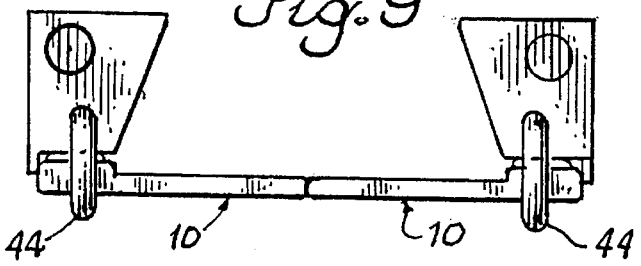
FIG. 9 is a top plan view of a martial arts board mounted to two martial arts boards holders, ready for receiving a blow.
Figure 10:
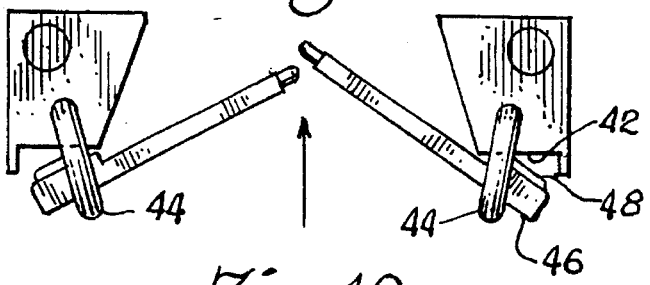
FIG. 10 is a top plan view of the arrangement of FIG. 9 after the board has been separated in to its halves by blow.
Figure 11:
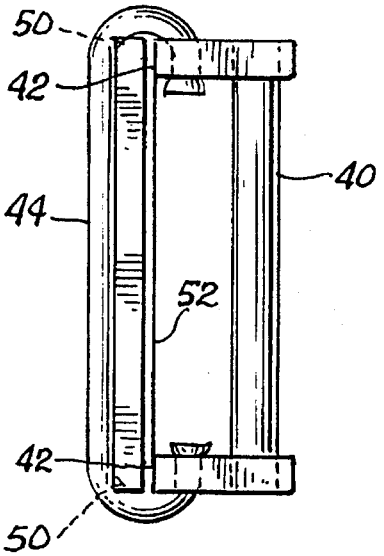
FIG. 11 is a side elevation view of one of the board holders.

There are other features of the invention which further increase the control that the person holding the board will have, and thus the confidence such person has that he or she will not be injured. Toward this end, there have already been developed board handles as shown in FIGS. 9, 10, and 11. These devices are similar to paper towel racks, having a handgrip 40 which the assistant will grip with the palm of his hand, and a stage 42, a flat surface on which the board half rests. To keep the board on the board holder, a resilient loop or "bungee cord" 44 extends from the board holder around the lateral edge 46 of each board half. For its part, the board half has a platform 48 which is adapted to seat on stage 42 of the respective board handle, with these two flat surfaces being held face-to-face by the retaining action of the resilient loop. These board holder handles are used for different martial arts boards and are not restricted to applicant's particular design. However, applicants board is designed specifically towards these board holders by proving a pair of oppositely positioned re-entrant notches 50, defined in the top and bottom edges of the respective board halves, spanning the lateral edges 46. These groves are fairly deep, and their mission is to prevent the board halves from springing loose from the bungee cords and possibly injuring the holder. The relatively deep relief of the groves ensures that this occurs, and the fly-away phenomenon which has occasionally occurred heretofore will never recur provided the retaining bungee cords are seated in the groves when the board is used.

FIGS. 9 and 10 illustrate the pivotal action of the board halves on the board holders as they are struck. From FIG. 10 it can be visualized how the board halves could free themselves from the retaining bungee cords upon receiving a heaver-than-usual impact, without the groves of the instant invention to prevent this. With the groves, the board halves swing into a stable position as shown in FIG. 10.

The third controllability innovation lies in the construction of the palm pads 52. In the past, these pads would tend to work themselves, or become worked, free of the board as the nervous students pick at them in class. Creating the strong bond between the pad and the board to eliminate this destructive effect is not easy, inasmuch as the board itself is made of tough ABS plastic and the dense, close-celled virtually airless foam of the pads has a low adhesion level to ABS. But a positive engagement must be made between the two for true durability. To this end, the body of the board, or of the board halves, includes, in addition to the planner portion of the boards striking surface, a series of parallel, spaced cylindrical cavities 54 are defined just rearwardly of the front panel 56. Each of these cylinder-defining structures is filled with the plastic of the pads in an injection process to form a "dead man", a construction term which refers to a buried log serving as a cable anchor. Each deadman, formed of molded plastic, communicates up through to the top, planer body of the palm pad through passageways 60.

When the pads are molded on to the perspective half boards, tendrils 62 pass through the planar top portion 64 of the palm pad down through these passageways 60 to merge integrally with the deadman formed in one of the cylinders 54. This connection is very durable. To further enhance its functionality, the passageways, which are three in number throughout a substantial portion of the platform as can be seen in FIG. 3 and 5, increase to 6 at the ends, and the deadmen are two- to three- times as wide as their internal counterparts. This reinforces the ends, where the pad is subject to being peeled, picked at and otherwise abused. Six end tendrils, plus the three tendrils for the other deadmen, creates a palm pad that is so durable it would be difficult to imagine it becoming dislodged no matter how many times the board is used.

In summary, the snap-action mating detentes, the retaining cord grooves, and the improved palm pads all produce a higher level of controllability of the board than was previously possible. There are substantial grounds for the belief that these innovations will find their way into homes and gyms as a relatively standard piece of equipment. Use of the board is cheaper in the long run than using its wooden counter part, and is ecologically more sound as well.

It is hereby claimed:

1. An improved martial arts board comprising:

(a) two planar board halves each having a mating edge and defining mating interengagement means along said edge such that said board halves are releasibly mutable along said respective mating edges to define a generally planar full board when assembled with a front surface defining an elongated breakaway zone there across at the juncture between said two halves whereby said halves separate upon being impacted by a blow of at least a threshold magnitude;

(b) said interengagement means being of interfitting mortise and tenon construction mutable by sliding said two planar board halves together in the plane defined by said full board in edge-to-edge abutted relation such that separation can be effected by reversal of the mating movement, or a hinging action caused by a sharp frontal blow to said breakaway zone; said board halves are identical such that each has both mortises and tenons reversed from, and thereby slidably interfitting with, those of the other of said coupling sets being a detent set which defines a dimple interface between the respective mortise and tenon wherein a concave dimple and a convex dimple longitudinally align with one another when sliding said two halves together, and noticeably snap into overlaid, seated relation when said board halves reach a fully mated position, such that each said detent set defines a positive detent; and (c) at least one snaplock detent which is forced to release when said halves separate, and to positively engage said board halves when forced back together after being used and to produce a sharp noticeable snap to signal complete closure of the two board halves as they are completely mated.

2. An improved martial arts board according to claim 1 wherein said at least one coupling set comprises two detent sets, and said two detent sets comprise the two most mutually laterally spaced sets on said full board, with each of said board halves defining one of the tenons and one of the mortises of said two detent sets, to permit said board halves to be mutually progressively laterally offset in increments of one mortise and tenon set, to vary the resistance of said full board to a frontal blow, while retaining the full detent effect of both of said detent sets.

3. An improved martial arts board according to claim 2 wherein a plurality of said sets inboard of said detent sets have mutual interfaces defining said concave dimple in order to accommodate the convex dimple of the respective detent set as said board halves laterally mutually migrate as they are progressively offset by increments to reduce board resistance to breaking force.

4. An improved martial arts board according to claim 2 wherein said dimples are positioned on the respective detent set such that the hinging motion that the two board halves undergo in response to a frontal blow tends to disengage the respective dimples as the board is broken, so that the gripping force between said dimples is effectively dramatically reduced without losing effectiveness in resisting longitudinal separating stress.

5. An improved martial arts board comprising:

(a) two planar board halves each having a mating edge and defining mating interengagement means along said edge such that said board halves are releasibly mutable along said respective mating edges to define a generally planar full board when assembled with a front surface defining an elongated breakaway zone there across at the juncture between said two halves whereby said halves separate upon being impacted by a blow of at least a threshold magnitude;

(b) said interengagement means being of interfitting mortise and tenon construction mutable by sliding said two planar board halves together in the plane defined by said full board in edge-to-edge abutted relation such that separation can be effected by reversal of the mating movement, or a hinging action caused by a sharp frontal blow to said breakaway zone; said board halves each comprises a body defining internal passageways, and a foam pad extended along the rear surface of a lateral side thereof, with foam material of said pads extending deep into said passageways to define positive anchors in said body; and (c) at least one snaplock detent which is forced to release when said halves separate, and to positively engage said board halves when forced back together after being used and to produce a sharp noticeable snap to signal complete closure of the two board halves as they are completely mated.

6. An improved board according to claim 5 wherein said passageways are increased in number at the ends of said pads to reinforce same and mitigate against fraying.

7. An improved board according to claim 5 wherein said passageways include dead man cavities and tendril-forming ducts communicating between said dead man cavities and said rear surface.

8. An improved board according to claim 5 wherein said dead man cavities are cylindrical and span transversely of the direction of extent of said respective pad and said tendril-forming ducts are on the order of three in number for each dead man except the outermost deadmen at which there are on the order of six tendrils.

9. An improved board according to claim 8 wherein said outermost deadmen are on the order of two to three times as wide as the others of said deadmen.

10. An improved martial arts board with breakaway halves and being specifically designed for use with a pair of board holders each of which defines a handgrip, a stage for seating a respective one of said halves, and an elastic loop for looping around and engaging said board, said board comprising:

(a) two planar board halves each having a mating edge and defining mating interengagement structure along said edge such that said board halves are releasibly mutable along said respective mating edges to define, when assembled, a generally planar full board with a front surface defining an elongated breakaway zone there across at the juncture between said two halves whereby said halves separate upon being impacted by a blow of at least a threshold magnitude;

(b) said board halves each defining a platform area to seat the stage of the respective board holder;

(c) securing means to positively engage said holder to prevent accidental shifting or separation of said halves from said holders in use; and (d) said securing means comprising at least one guide for said respective elastic loop, said guides each comprises a pair of spaced grooves in two opposite front edges of each board half.

11. An improved board according to claim 10 wherein said platforms have surfaces defined by pads to seat more wear-lessly on said stages.

* * * * *